US008220612B2

(12) United States Patent
Matheisl et al.

(10) Patent No.: US 8,220,612 B2
(45) Date of Patent: Jul. 17, 2012

(54) STEP FOR ESCALATOR, AND ESCALATOR WITH SUCH A STEP

(75) Inventors: Michael Matheisl, Österreich (AT); Thomas Novacek, Österreich (AT); Kurt Streibig, Österreich (AT); Andreas Trojer, Österreich (AT)

(73) Assignee: Inventio AG, Hergiswil NW (CH)

( * ) Notice: Subject to any disclaimer, the term of this patent is extended or adjusted under 35 U.S.C. 154(b) by 115 days.

(21) Appl. No.: 12/680,775

(22) PCT Filed: Sep. 26, 2008

(86) PCT No.: PCT/EP2008/062965

§ 371 (c)(1),
(2), (4) Date: Jun. 9, 2010

(87) PCT Pub. No.: WO2009/047144

PCT Pub. Date: Apr. 16, 2009

(65) Prior Publication Data

US 2010/0282570 A1 Nov. 11, 2010

(30) Foreign Application Priority Data

Oct. 1, 2007 (EP) ..... 07117651

(51) Int. Cl.
*B66B 21/00* (2006.01)

(52) U.S. Cl. ..... 198/333; 198/327

(58) Field of Classification Search ..... 198/326–333
See application file for complete search history.

(56) References Cited

U.S. PATENT DOCUMENTS

| | | | | |
|---|---|---|---|---|
| 4,775,043 | A * | 10/1988 | Tomidokoro | 198/328 |
| 5,050,721 | A * | 9/1991 | Sansevero et al. | 198/328 |
| 6,978,876 | B1 * | 12/2005 | Tsukahara et al. | 198/333 |

FOREIGN PATENT DOCUMENTS

| | | | |
|---|---|---|---|
| EP | 1 479 638 | A | 11/2004 |
| GB | 2 173 757 | A | 10/1986 |
| GB | 2 216 825 | A | 10/1989 |
| JP | 50 016282 | | 2/1975 |
| JP | 54 159990 | A | 12/1979 |
| JP | 62 270224 | A | 11/1987 |
| JP | 2001 310889 | A | 11/2001 |

* cited by examiner

*Primary Examiner* — Mark A Deuble
(74) *Attorney, Agent, or Firm* — Ladas & Parry LLP

(57) ABSTRACT

The step (1) comprises cheeks (5) which are manufactured from deep drawing sheet metal, and a tread element (22) and a deep drawn seating element (24). The arc (BO1) of the seating element (24) follows a first radius (R1) in the upper region and a second radius (R2) in the lower region, wherein the second radius (R2) is somewhat smaller than the first radius (R1). The sheet (BO1) of the seating element (24) merges smoothly at the line (ÜR) from one radius into the other radius. By way of the two radii (R1, R2), the size of the step gap between the tread element (22) and the seating element (24) of the adjacent step is independent of the position of the step gap; the step gap always remains very small, for example smaller than 2.8 mm. As a result, the risk of clothing items, sharp objects, shoes, children's fingers and so on getting jammed is reduced considerably.

8 Claims, 7 Drawing Sheets

STEP FOR ESCALATOR, AND ESCALATOR WITH SUCH A STEP

TECHNICAL FIELD

The invention relates to a step for an escalator, with a step skeleton, which is made of sheet metal parts, as support for at least one tread element and at least one riser element, wherein the riser element has a web/groove profile, which is made from deep-drawn sheet metal, with webs and grooves and each web has a cavity as seen from the riser element underside and the riser element extends curvilinearly.

BACKGROUND OF THE INVENTION

A step for an escalator has become known from the specification DE 3605284 A. The step comprises a tread element with a plurality of horizontally extending strips and a riser element with a plurality of vertically extending strips. The strips of the tread element mesh with the strips of the riser element of the adjacent step, wherein the step width is dependent on the relative position of the adjacent steps.

A step of the kind stated in the introduction is known from U.S. Pat. No. 6,978,876 B. see, particularly FIGS. 5 and 6. Weight savings and considerable cost savings are possible with the skeleton-like sheet metal construction of the step.

A step executes a relative movement to the adjacent steps in vertical direction, particularly in the transition from the inclined escalator section to the horizontal escalator section. The step structure of the escalator is in that case transferred into a planar structure or band structure. The height difference between two adjacent steps then changes continuously from the maximum value to zero. The relative movement is produced by an appropriate course of the guide tracks for the step rollers and chain rollers. The step has—in section in travel direction—an approximately triangular cross-section. In order to keep the gap between two steps small, however, the riser element is constructed not to be flat, but as a cylinder wall section, thus arcuate in cross-section, so that the step in section in travel direction has the form of a sector of a circle rather than that of a triangle.

BRIEF SUMMARY OF THE INVENTION

As was established within the scope of the present invention, the gap between two steps is not, however, constant, but changes according to how large the height difference between two adjacent steps happens to be.

It is the object of the present invention to eliminate this disadvantage. According to the invention this is achieved by a step having a sheet metal skeleton that supports a riser and tread. The riser extends curvilinearly towards the tread and has at least two regions with different radii of curvature. the concave sides of the regions facing towards the step inside. A step formed in that manner has the effect that the step gap is constantly small. almost independent of the instantaneous height difference of two adjacent steps.

In accordance with the invention the step gap between the tread element and the adjacent riser element thus always remains almost the same size regardless of the position of the step gap. The risk of accident or the risk of catching items of clothing, sharp objects, shoes, children's fingers and so forth is thereby thus further substantially reduced. Particularly in the transition from the inclined run to the straight run of the escalator the step gap no longer opens up, but also there always remains the same size.

Not only weight savings and considerable cost savings are possible with the skeleton-like sheet metal construction of the step, but a particular advantage also consists in that almost any shapes can be produced without additional effort being necessary in production and without different cross-sections arising, which would have to be taken into consideration statically. This is because it is very simple to realise a different radii of the riser element particularly with steps of that kind made of deep-drawn sheet metal.

Lighter steps also mean a lower drive power for the escalator drive. The significant components of the steps, such as, for example, step cheeks, tread element and riser element, are produced from thin deep-drawn sheet metal by means of a deep-drawing method. Notwithstanding the thin sheet metal, the step satisfies the prescriptions and load tests of European Standard EN 115 as well as American Standard ASME A17.1, according to which the step has to satisfy a static test and a dynamic test. In the static test the step is centrally loaded with a force of 3000 N acting perpendicularly to the tread element, wherein a deflection of at most 4 mm may occur. After the action of the force, the step should not have any persisting deformation. In the dynamic test the step is centrally loaded by a pulsating force, wherein the force varies between 500 N and 3000 N at a frequency between 5 Hz and 20 Hz and at least $5\times10^6$ cycles. After the test the step may have a residual deformation of at most 4 mm.

It is further advantageous that the components can be produced in production-optimised manner from a sheet metal roll—which is held by means of an unwinding device and can be unwound—of, for example, 2 m to 4 m diameter hereinafter, called sheet metal coil. The work flow can be designed to be free of interruption and production time further reduced by multiple unwinding devices.

A step with skeleton-like or frame-like sheet metal construction is lighter and substantially more economic than a die-cast step of aluminium, particularly in view of the increasing price of aluminium. A 600 mm wide step still weighs approximately 8.6 kg, an 800 mm wide step still weighs approximately 10.8 kg and a 1000 mm wide step still weighs approximately 13.1 kg. It is additionally advantageous with this mode of construction that the step width or also the change-over process in a case of small batch numbers does not require expensive additional operations. A step optimised with respect to minimum weight and maximum load according to the above-mentioned EN 115 is possible with thin deep-drawn sheet metals of, for example 1.1 to 1.9 mm thickness, which by means of a deep-drawing method enable a maximum stiffness of the load-bearing components. Stamping or bending methods would also be conceivable, but the finished step would be substantially heavier, because in these production methods greater sheet metal thicknesses (at least 4 mm sheet metal thickness) are necessary.

The riser element produced from thin deep-drawn sheet metal, which is deep-drawn from, for example, 0.25 to 1.25 mm thickness to 10 to 15 mm, has by its web/groove section sufficient stiffness in the case of extreme loads. Notwithstanding increased stiffness, however, the weight of the tread element remains small.

In the case of a sheet metal thickness of 0.4 mm the riser element weighs 0.7 kg for a step width of 600 mm, 0.9 kg for a step width of 800 mm and 1.1 kg for a step width of 1000 mm. The strength of the riser element is dependent on the material. In the case of a riser element produced from deep-drawn sheet metal with the designation H380 the elastic limit is at 380 to 480 N/mm$^2$. Thereafter the material goes into the plastic range. The yield point is at 400 to 580 N/mm$^2$. In the case of a riser element produced from deep-drawn sheet metal with the designation H400 the elastic limit is at 400 to 520 N/mm$^2$. The material thereafter goes into the plastic range. The yield point is at 470 to 590 N/mm$^2$. In the case of a riser element produced from deep-drawn sheet metal with the designation H900 the elastic limit is at 790 N/mm$^2$. The material thereafter goes into the plastic range. The yield point is at 900 N/mm$^2$. In the case of a riser element produced from deep-drawn sheet metal with the designation H1100 the elastic limit is at 1020 N/mm$^2$. The material thereafter goes into the plastic range. The yield point is at 1100 N/mm$^2$.

The riser element according to the invention can also be used with steps which have, instead of the centre cheeks, bridge-like cross members connecting the side cheeks.

In the deep-drawing method a die presses a planar sheet metal blank into a prefabricated die plate, wherein the edge of the sheet metal die is held fast by means of a holding-down device. In the case of cold deforming, which is produced by die and die plate, of the deep-drawn sheet metal a transient plasticising and cold-hardening of the deep-drawn sheet metal takes place below the holding-down device. A three-dimensional body with base and encircling walls is formed from the two-dimensional sheet metal blank, which is usually punched from a sheet metal strip or a sheet metal panel, wherein the wall thickness is slightly smaller than the original sheet metal thickness. The base can be reshaped in further method steps, for example by means of hydraulic drawing into the die or the die plate. In the exemplifying embodiment explained in the following the cheek eyes are thus produced. After the reshaping, the edge is separated from the walls by trimming, for example by means of a knife, punch, water jet or laser. The deep-drawn sheet metal has to be provided specifically for the reshaping. In the exemplifying embodiment explained below use is made of, for example, a deep-drawn sheet metal with the designation H380 or H400. These steel types are substantially based on the strength-enhancing action of microalloying additives such as, for example, niobium and/or titanium and/or manganese. The yield points, which are high by comparison with soft steels, of these steel categories allow cold deforming, with low deforming load, to the point of very demanding and complex component shapings. The steel categories are matched to the respective deformation conditions, so that even in the case of small sheet metal thicknesses the tendency to deformation-induced contractions, formation of folds, tears or shape inaccuracies due to resilient springback is minimal. The deep-drawing method is distinguished by a large ratio of sheet metal thickness to height of the deep-drawn wall as well as the high degree of load-bearing capability, accuracy in shape and stability connected therewith.

In the case of a roll reshaping method, also termed continuous bending method, a sheet metal strip from the sheet metal coil is reshaped with the help of several roll pairs or roller pairs, which are arranged one behind the other, by cold deforming to form sections with high load-bearing capability.

BRIEF DESCRIPTION OF THE DRAWINGS

The present invention is explained in more detail by way of the accompanying figures, in which.

DETAILED DESCRIPTION OF A PREFERRED EMBODIMENT

Figure 1:
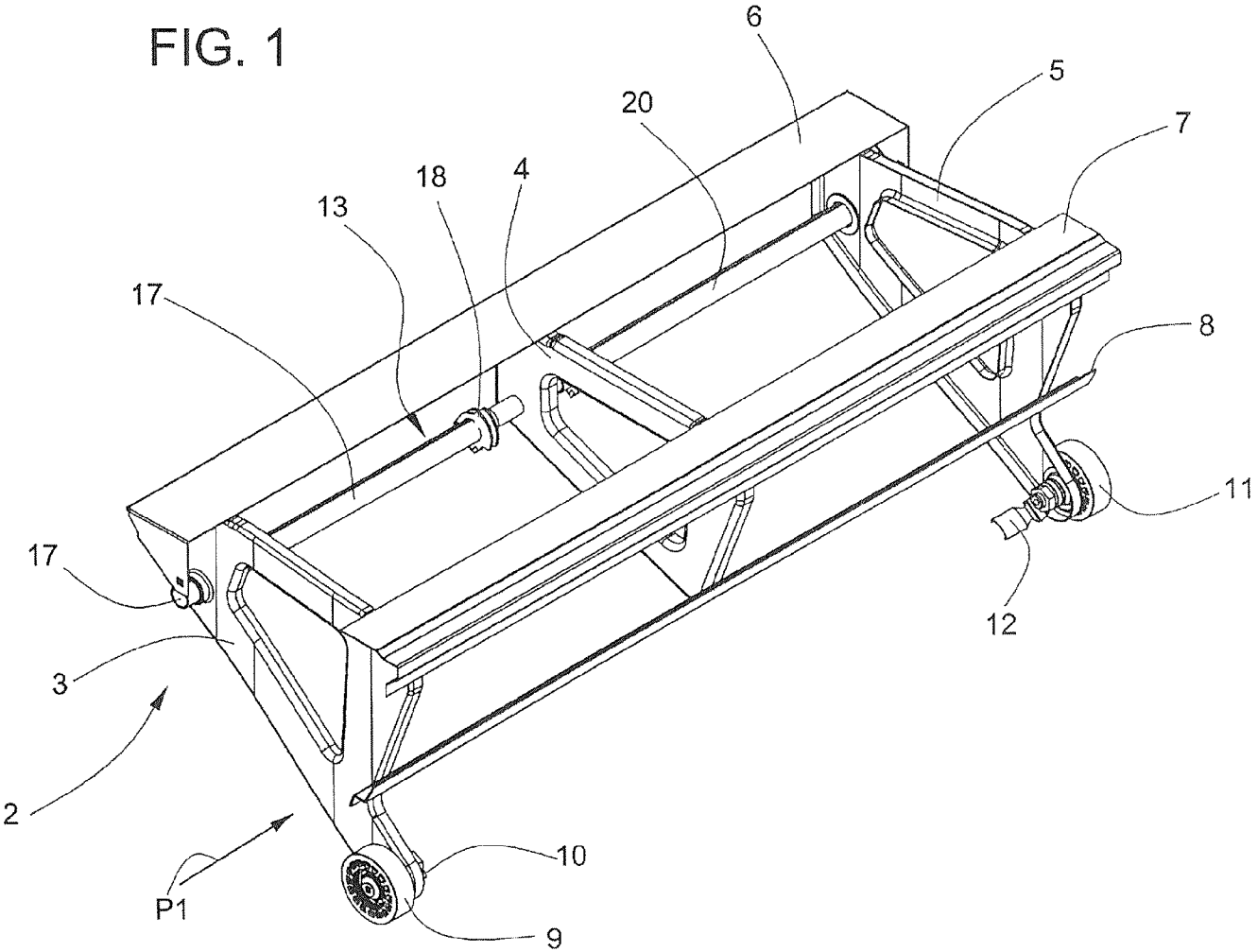
FIG. 1 shows a skeleton of the step according to the invention.

FIG. 1 shows a step skeleton 2 of the step 1 according to the invention. The step skeleton 2 consists of a first cheek 3, at least one centre cheek 4 and a second cheek 5. First and second cheeks 3, 5 are also termed side cheeks and are arranged in mirror image. The cheeks 3, 4, 5 are arranged in travel direction. A sheet metal blank is punched from a sheet metal strip for each cheek 3, 4, 5 and this blank is subsequently reshaped by means of a deep-drawing method to form the cheek. A carrier 6, a bridge 7 and a bracket 8 extend transversely to the travel direction and connect the cheeks 3, 4, 5, wherein the components are connected without screws, for example by means of a spot-welding method. Cheeks 3, 4, 5, carrier 6, bridge 7 and bracket 8 form the step skeleton. The components of carrier 6, bridge 7 and bracket 8 are produced in endless manner from the sheet metal coil by means of a roller reshaping method, for example with a production speed of 10 to 20 metres per minute, and cut to length according to the respective step width. Stainless steel sheet or zinc sheet or copper sheet or brass sheet with a thickness of 1.8 to 3.3 mm is provided for the components of carrier 6, bridge 7 and bracket 8. Other constructional materials such as, for example, synthetic fibre composites or natural fibre composites or carbonfibre composites or glassfibre composites or plastics materials are also possible.

A step roller 9 and an emergency guide hook 10 are arranged at the first cheek 3. A step roller 11 and an emergency guide hook 12 are arranged at the second cheek 5. The step roller 9, 11 guides the step 1 along a guide track of the escalator. The emergency guide hook 10, 12 is supported, in the event of failure of the step roller 9, 11, on an emergency guide of the escalator and forces the step 1 back to the guide track.

The step 1 is connected with the step chain of the escalator by means of a step axle 13. The step axle 13 is of multi-part construction. An axle pin 14 made from a round material is rotatably mounted in a bush 15, which serves as slide bearing, of the centre cheek 4. A bush 16 serving as a slide bearing is arranged at the first cheek 3, wherein a first entrainer axle 17 is rotatably mounted at one end in the bush 16 and is connected at the other end by means of a shackle 18 with the axle pin 14 of the centre cheek 4. A bush 19 serving as a slide bearing is arranged at the second cheek 5, wherein a second entrainer axle 20 is rotatably mounted at one end in the bush 19 and is connected at the other end by means of a shackle 21 with the axle pin 14 of the centre cheek 4.

The entrainer axles 17, 20 are produced from sheet metal coil by means of a roll deforming method and cut to length depending on the respective step width. With the shackle 18, 21 released the entrainer axle 17, 20 is pushed, at each side of the step 1, over a chain pin of the step chain and the shackle 18, 21 retightened, whereby the step 1 is connected with the step chain moving the step 1.

The step axle 13 forms, together with the chain pin, a continuous axle from one chain roller to the opposite chain roller. The step 1 is thus carried at one end by the chain rollers and at the other end by the step rollers 9, 11.

Figure 2:
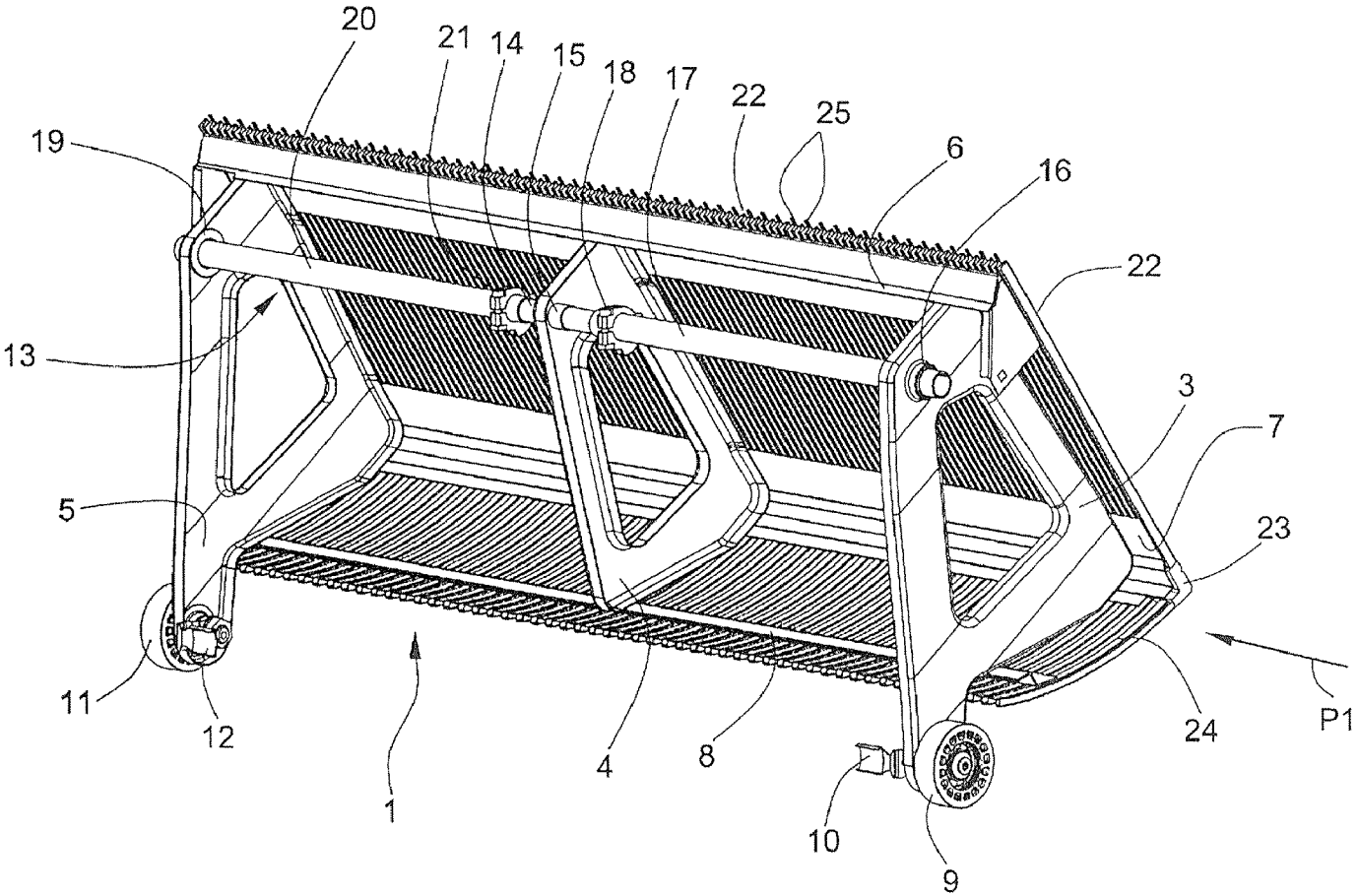
FIG. 2 shows the step according to the invention.

FIG. 2 shows the complete step 1 as seen from below, in which the step skeleton 2 has been supplemented by a tread element 22, a step edge 23 and a riser element 24. The tread element 22 and/or the riser element 24 can also consist of more than one part. For example, the one-piece tread element 22 or the one-piece riser element 24 can be divided longitudinally as seen in travel direction and/or transversely thereto. The tread element 22 and also the riser element 24 are produced in two stages. In a first stage the sheet metal drawn off the sheet metal coil is straightened and pre-shaped or pre-corrugated by means of a splined shaft to the extent of approximately 50% and subsequently cut to length depending on the respective step spacing. In a second stage the pre-shaped component is reshaped by means of a deep-drawing method to form the final web/groove profile with webs and grooves. The curve BO1 of the riser element is produced at once in the same deep-drawing process. The tread element 22 and also the riser element 24 can also be deep-drawn in one step, wherein 3 to 10 webs and grooves are deep-drawn, the deep-drawn sheet metal is subsequently pushed onward, then a further 3 to 10 webs and grooves are deep-drawn, and so on. In total, a deep-drawn sheet metal plate of, for example, 0.25 to 1.25 mm thickness is deep-drawn to 10 to 15 mm The web/groove profile of the tread element 25 has on the support side at each second web a small tooth 25 which meshes with the web/groove profile of the riser element 24 of the adjacent step. The gap between the steps is thereby set forward and set back.

The step edge 23, which, for example, is made of ceramic or natural fibre or plastics material in an injection-moulding process or of aluminium in a die-casting process, is placed on the bridge 7 and screw-connected or riveted or glued or clinched or plugged-on from below with the bridge 7. Other materials such as plastics material, natural fibre materials, synthetic fibre materials, glassfibre composites, carbonfibre composites or stainless steel and also colours such as yellow, red, black, blue or mixed colours are possible. The step edge 23 is so constructed that the tread element 22 and also the riser element 24 can be pushed into the step edge 23.

Figure 3:
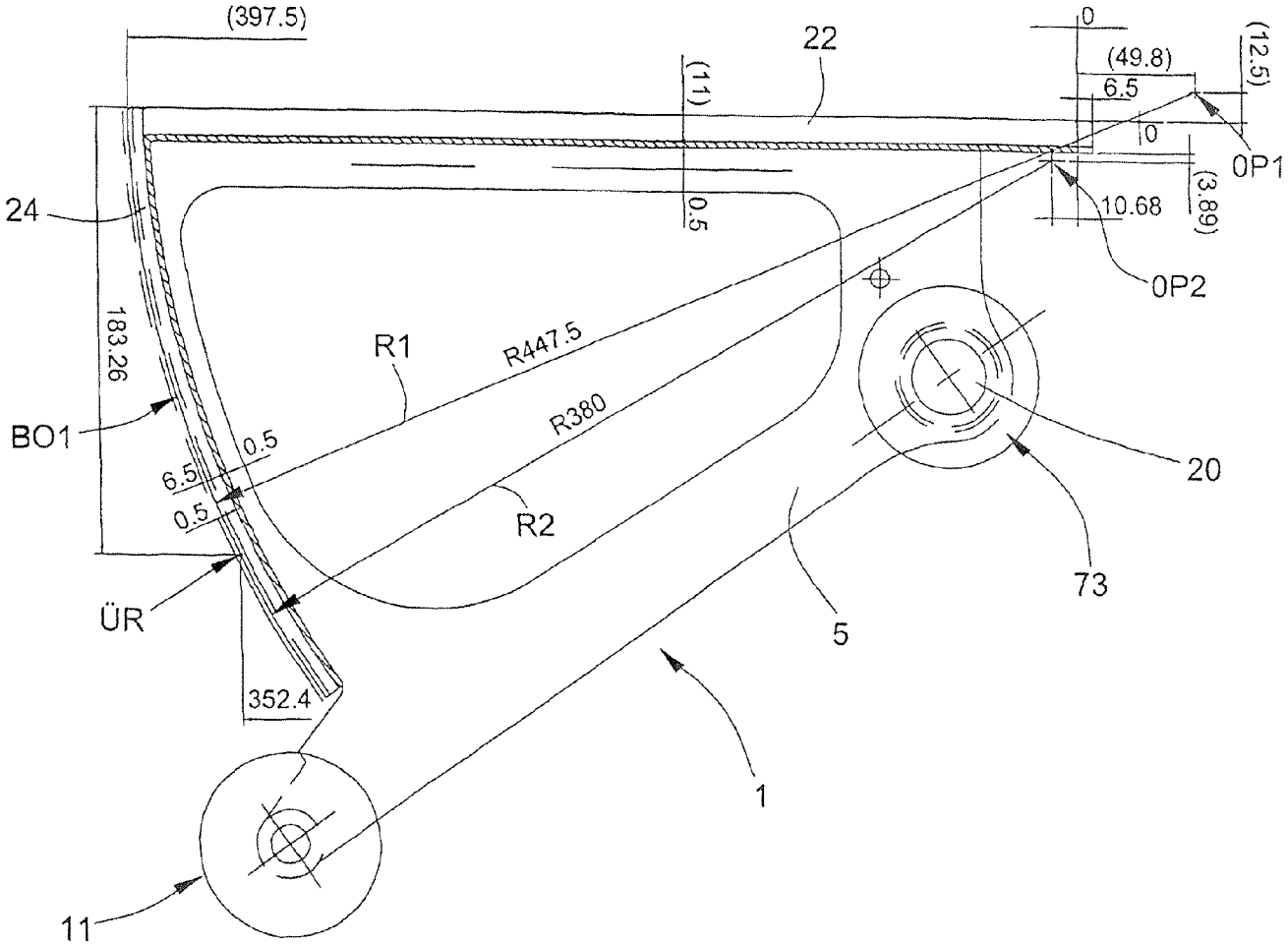
FIG. 3 shows a side view of the step.

FIG. 3 shows a side view of the step 1 as seen on the second cheek 5. The tread element 22 is connected with the carrier 6 and the bridge 7 in screw-free manner, for example by means of a spot-welding method. The riser element 24 is pushed into the step edge 23 and connected with the bracket 8 in screw-free manner, for example by means of a spot-welding method or a clinching method. The curve BO1 of the riser element 24 follows a first radius R1 in the upper region and a second radius R2 in the lower region, wherein the second radius R2 is smaller than the first radius R1. The curve BO1 can also have more than two different radii. The curve BO1 of the riser element 24 goes over from one radius to the other radius at the line ÜR. The position of the line ÜR is determined by the smallest escalator inclination of, for example, 27°. At this inclination as also at greater escalator inclinations of, for example, 30° or 35° the step gap SP1 is as small as possible and almost always the same. With the two radii R1, R2 the step gap SP1 between tread element 22 and riser element 24 of the adjacent step remains always the same small size regardless of the position of the step gap SP1 shown in FIG. 6 to FIG. 9. The step gap SP1 can be slightly greater or smaller depending on the escalator inclination.

R1 is, for example, 447.5 mm and has its origin at the point denoted by OP1. R2 is, for example, 380 mm in size and has its origin at the point denoted by OP2. These radii are applicable to chain links with a length of 133.33 mm or to a chain pitch of 133 mm. In a case of chain pitch of 200 mm, there results for R1, for example, 426 mm and for R2, for example, 380 mm. In a case of chain pitch of 400 mm there results for R1, for example, 410 mm and for R2, for example, 380 mm. The exact position of the origin points OP1, OP2 is made uniform. The radii R1, R2 were determined empirically by tests and constructions. Further explanations with respect thereto are illustrated by FIG. 5.

Depending on the respective customer wish, stainless steel, aluminium, synthetic/natural fibre composites, glassfibre composites, carbonfibre composites, ceramic, copper, brass, manganese/titanium sheet and so forth are, for example, also conceivable for the tread element 22 and/or for the riser element 24.

Figure 4:
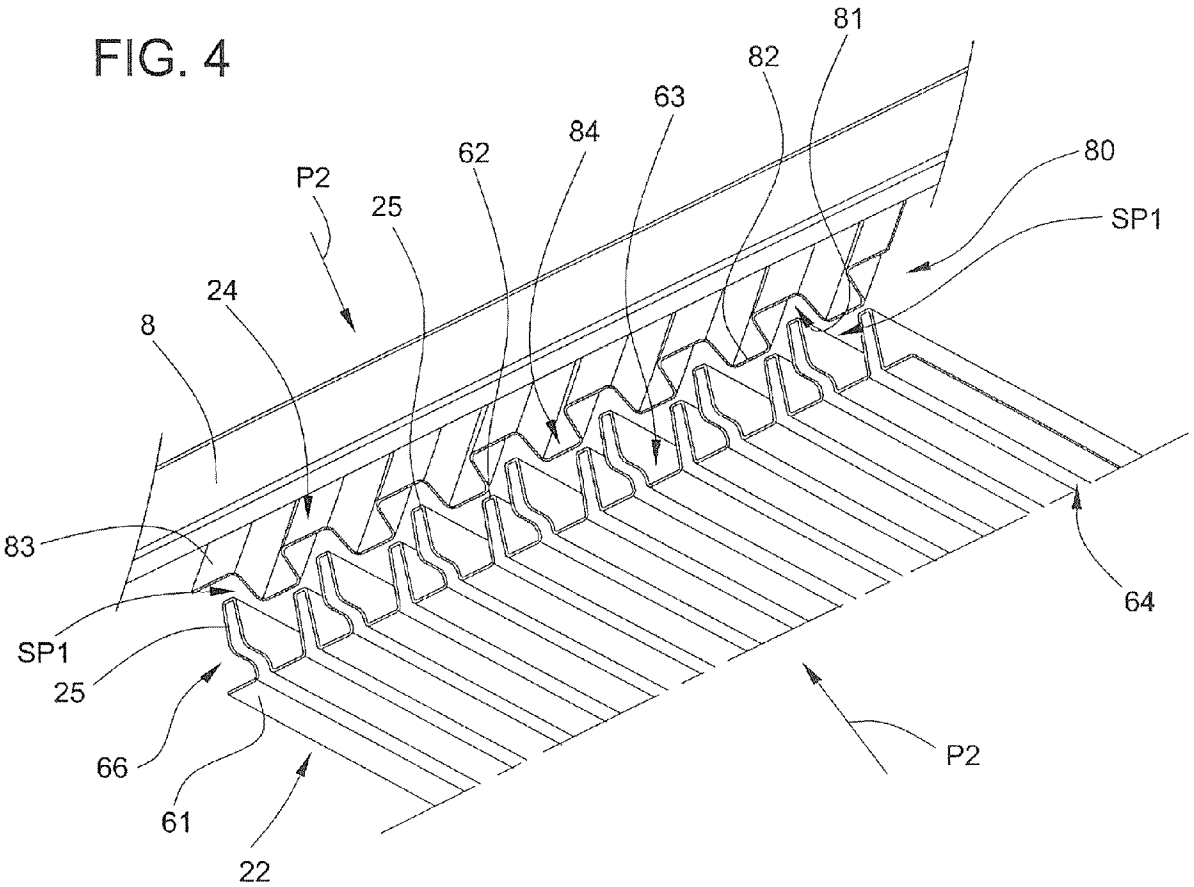
FIG. 4 shows a tread element meshing with a riser element of the adjacent step.

FIG. 4 shows in three-dimensional view the tread element 22 of the adjacent step and the riser element 24, which is produced from deep-drawn sheet metal 83, in the gap region, wherein the spacing between the tread element 22 and the riser element 24 forms the step gap SP1. Like the step 1, in FIG. 2 the three-dimensional detail is also shown as seen from below. The teeth, which are designated by 25, of the tread element 22 mesh with the web/groove profile 80 of the riser element 24. The web/groove profile 80 of the riser element 24 consists of webs 82 and grooves 81, wherein each web 82 as seen from below (in arrow direction P2) forms a cavity 84 which for stiffening of the riser element 24 can be provided with a filling. In each instance one tooth 25 reaches into an adjacent groove 81 of the riser element 24. The step gap SP1 between the tread element 22 and the riser element 24 is thereby set forward and out back. The deep-drawn sheet metal 61 deformed by means of a deep-drawing process forms the web/groove section 66 with webs 62 and grooves 63 extending in travel direction. The webs 62 and grooves 63 form the tread element 22, wherein the webs 62 form the tread surface for the users of the step 1 or of the escalator. Each web 62 forms a cavity 64 as seen from below (in arrow direction P2).

Figure 5:
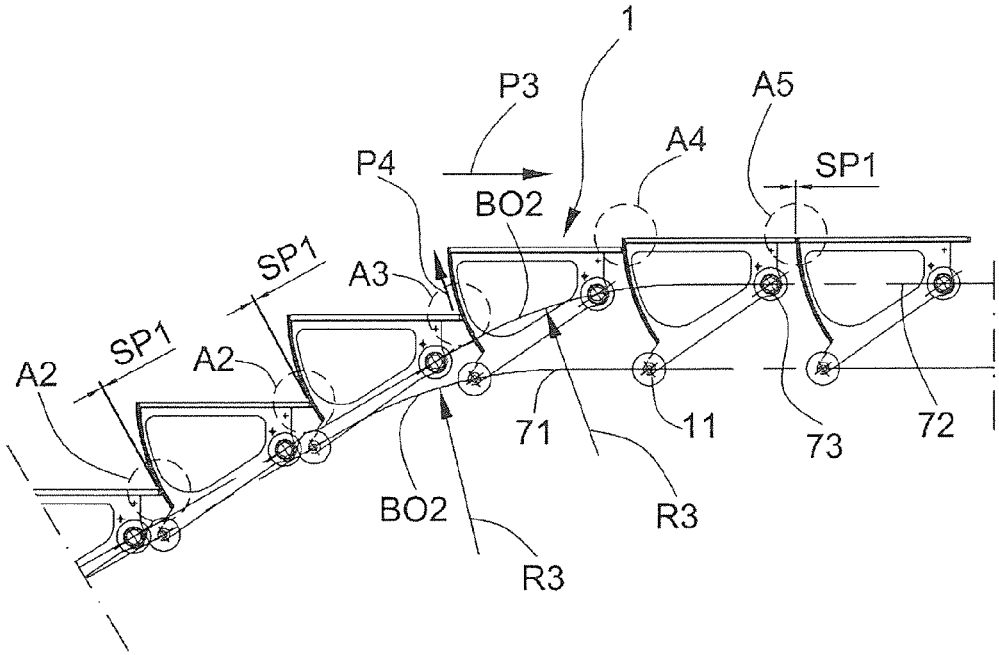
FIG. 5 shows an escalator at the transition from the inclined running to the straight running.

FIG. 5 shows an escalator at the transition from the inclined run to the straight run. In that case the visible step height as seen in travel direction P3 is decreasing and is 0 mm height in the straight run. The step gap SP1 continuously changes its position relative to the riser element 24 of the step 1 and migrates from below to above as shown by an arrow P4. The step gap SP1 is always almost of the same size regardless of whether the escalator forms visible steps or whether the escalator forms a plane. In the case of an angle of inclination of 30° or 35° the step gap SP1 is very narrow, for example 2.8 mm. The formation of a staircase or of a plane is achieved by guide tracks 71 which guide the step rollers 9, 11 and by guide tracks 72 which guide the chain rollers 73. The transition curve of the guide tracks 71, 72 is denoted by BO2 and the radius of the transition curve BO2 is denoted by R3 and at least 1000 mm in size.

Due to the departure of the step chain from the guide track 72 the step gap SP1 in the transition curve BO2 is a little smaller, since the step chain with chain links of, for example, 133.33 mm or 200 mm length forms the chord to the transition curve BO2. The radii R1. R2 of the riser element 24 provide compensation for this shortening acting on the step gap SP1. By virtue of the step geometry and in the case of a small radius R3 of the transition curve BO2 of, for example, 1000 mm to 1500 mm the step gap SP1 is smallest. In the case of rapid rising of the tread element 22 the step chain describes a clear segmentation and forms the largest or strongest chord. By way of the transition curve BO2 the step gap SP1 is very strongly dependent on the construction of the riser element 24 and is variable. In order to achieve a smallest possible step gap SP1 an elevation of the riser element by means of a larger radius R1, for example 447.5 mm, is necessary. In the case of other chain pitches, the radii have a size as explained further above.

Figure 6:
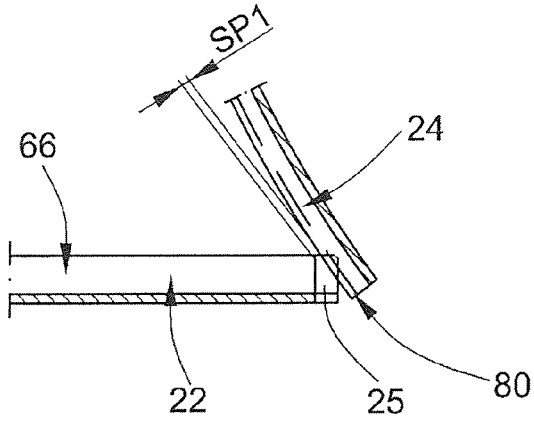
FIGS. 6 to 9 show a step gap between tread element and riser element of the adjacent step in different relative settings of the adjacent step.
Figure 7:
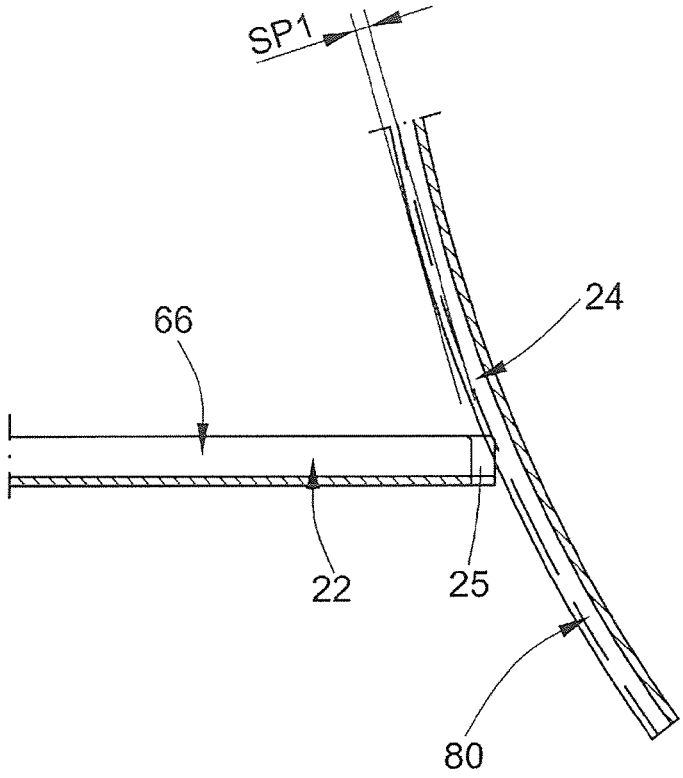
Figure 8:
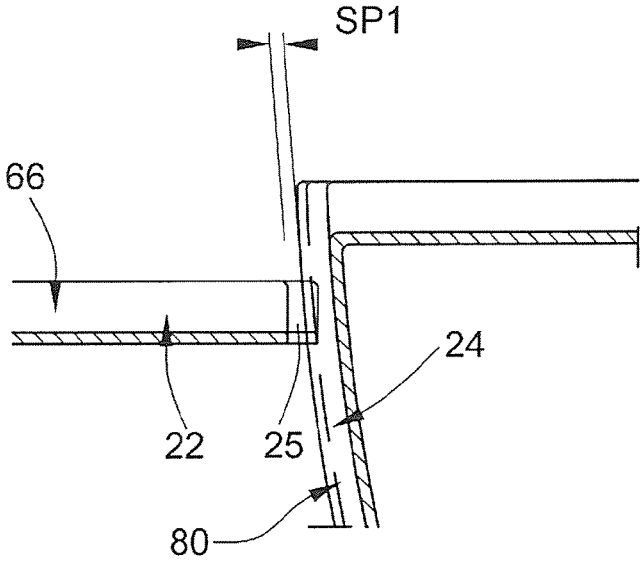
Figure 9:
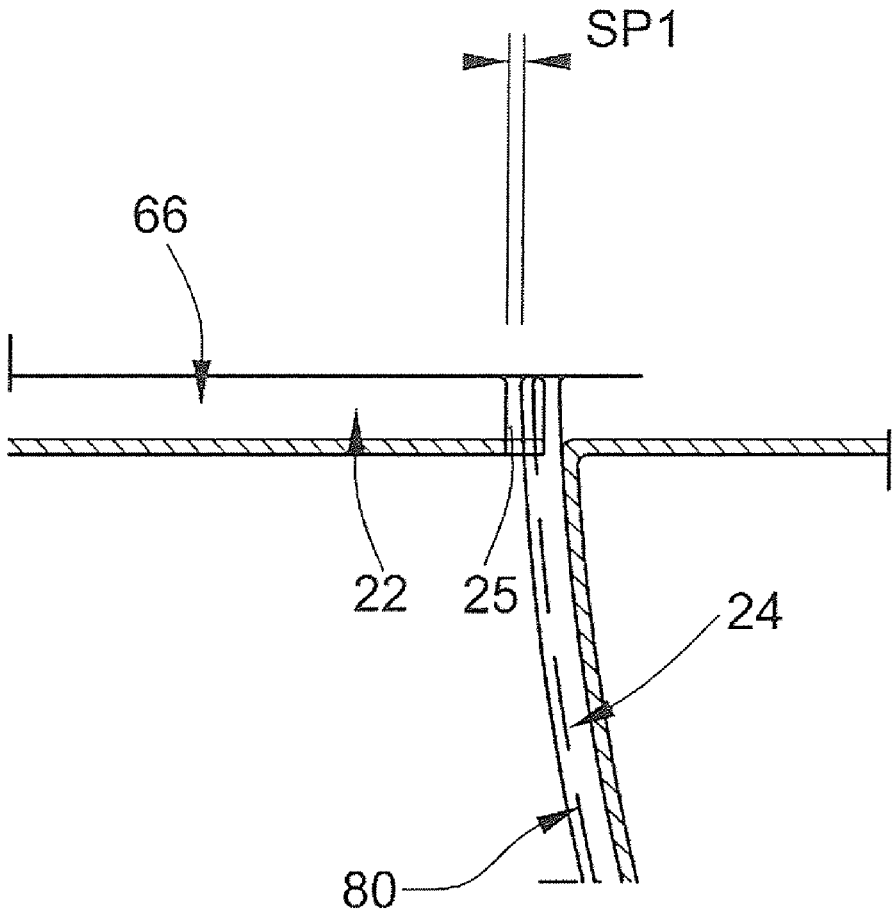

FIG. 6 to FIG. 9 show the details A2 to A5 of FIG. 5 with the constant step gap SP1 between riser element 24 and tread element 22 of the adjacent step. FIG. 6 shows the step gap SP1 at full step height. FIG. 7 shows the step gap SP1 at approximately half step height in the transition region. FIG. 8 shows the step gap SP1 at minimum step height. FIG. 9 shows the step gap SP1, without step height, in the straight run.

The invention claimed is:

1. A step for an escalator, the step comprising a step skeleton having sheet metal parts supporting at least one tread element and at least one riser element, wherein the at least one riser element has a web/groove profile of deep-drawn sheet metal with webs and grooves, each web having a cavity as seen from an underside of the riser element, the at least one riser element extending with a curve curvilinearly towards the tread element, the curve having at least two regions, each with a different constant radius of curvature, concave sides of each region facing towards an inside of the step.

2. A step according to claim 1, wherein the curve has a first radius in an upper region adjacent to the tread element and a second radius of curvature in a lower region, wherein the second radius of curvature is smaller than the first radius of curvature.

3. A step according to claim 2, wherein the first radius of curvature is chosen from the group comprising approximately 447.5 millimeters, approximately 426 millimeters, and approximately 410 millimeters, and the second radius of curvature is chosen from the corresponding group comprising approximately 380 millimeters, approximately 380 millimeters, and approximately 380 millimeters.

4. A step according to any one of claims 1 to 3, wherein the deep-drawn sheet metal contains at least one microalloying additive and the web/groove profile is deep-drawn to 10 to 15 millimeters with a sheet metal thickness of 0.25 to 1.25 millimeters.

5. A step according to any one of claims 1 to 3, wherein the deep-drawn sheet metal has an elastic limit in a range of 380 $N/mm^2$ to 520 $N/mm^2$ or 790 $N/mm^2$ to 1020 $N/mm^2$, and a corresponding yield point in the range of 440 $N/mm^2$ to 590 $N/mm^2$ or 900 $N/mm^2$ to 1100 $N/mm^2$.

6. A step according to any one of claims 1 to 3, wherein the sheet metal thickness of the deep-drawn sheet metal is 0.4 millimeters.

7. An escalator with at least one step according to claim 1.

8. A step construction for an escalator, the construction comprising first and second adjacent steps, each of the first and second steps comprising a step skeleton having sheet metal parts supporting at least one tread element and at least one riser element, wherein the at least one riser element has a web/groove profile of deep-drawn sheet metal with webs and grooves, each web having a cavity as seen from an underside of the riser element, the at least one riser element extending with a curve curvilinearly towards the tread element, the curve having at least two regions, each with a different constant radius of curvature, concave sides of each region facing towards an inside of the step, the first and second steps being separated by a step gap of no greater than 2.8 millimeters.

* * * * *